US005398669A

United States Patent [19]

McCullough et al.

[11] Patent Number: 5,398,669

[45] Date of Patent: Mar. 21, 1995

[54] EXPLOSION DAMPENER

[76] Inventors: Sam McCullough, 2431 Sinclair Circle, Burlington, Ontario, L7P 3K1; Russell E. Reyher, 3 Winfield Way, Winnipeg, Manitoba, R2R 1V8, both of Canada

[21] Appl. No.: 142,958

[22] Filed: Oct. 29, 1993

[51] Int. Cl.[6] ..... F24C 3/00

[52] U.S. Cl. ..... 126/512; 126/285 R; 110/173 B

[58] Field of Search ..... 126/85 B, 116 R, 285 R, 126/293, 512, 290–292; 110/173 B, 173 R; 251/60

[56] References Cited

U.S. PATENT DOCUMENTS 3,289,729 12/1966 Reed ..... 126/285 R
3,588,068 6/1971 Huntington ..... 110/173 R
4,040,564 8/1977 Waeldner ..... 251/60
5,307,801 5/1994 Schroeter ..... 126/512

FOREIGN PATENT DOCUMENTS 224789 5/1962 Germany ..... 110/173 B

*Primary Examiner*—James C. Yeung

[57] ABSTRACT

An explosion dampener fits with a pressure relief opening in a gas fireplace. The explosion dampener comprises a fireplace mounting bracket, a lever arm pivotally secured to the mounting bracket and an opening sealing member which is secured by a floating connection to the lever arm. The floating connection between the sealing member and the lever arm promotes a sealing fit of the sealing member over the pressure relief opening in the gas fireplace.

5 Claims, 3 Drawing Sheets

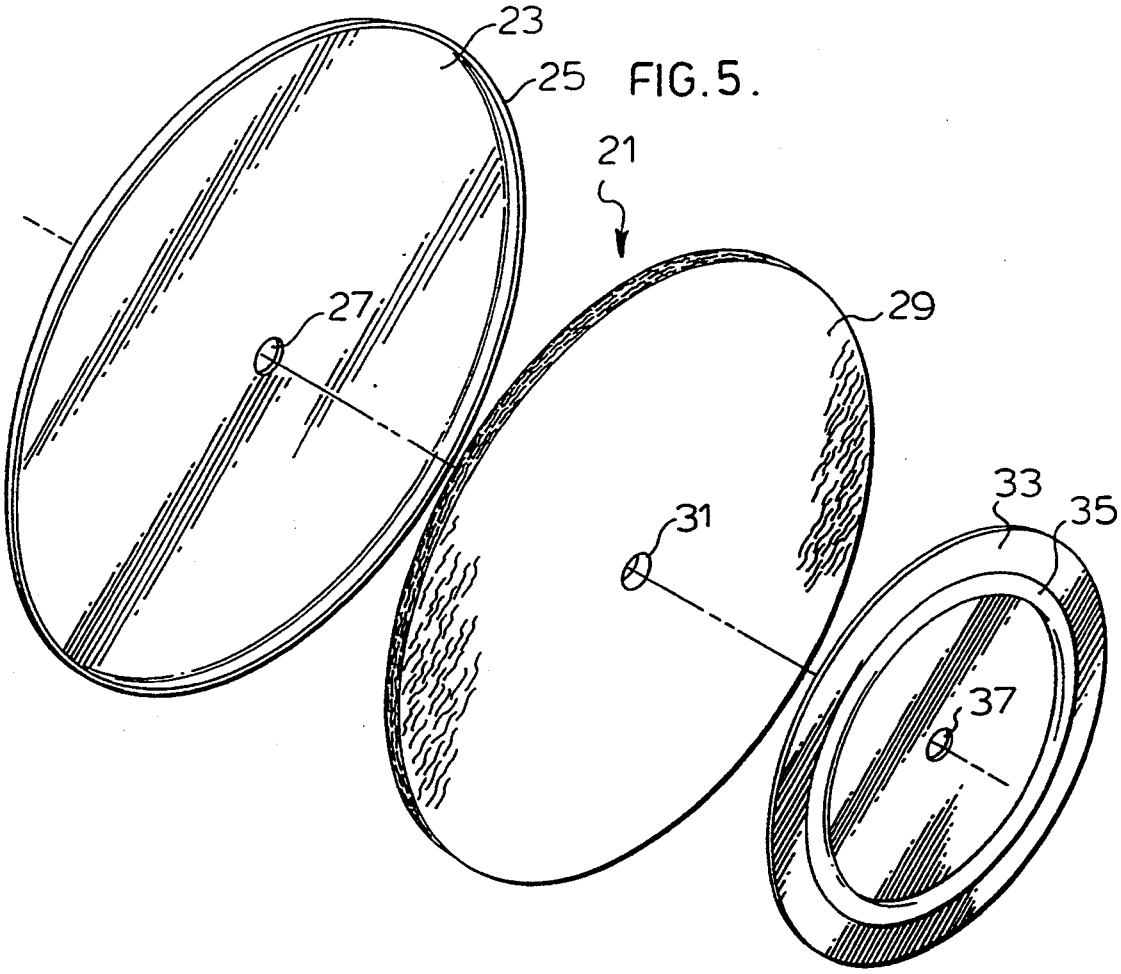
FIG. 5.
FIG. 6.
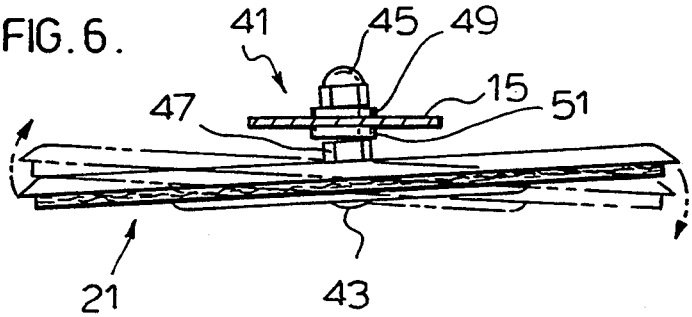
FIG. 7.
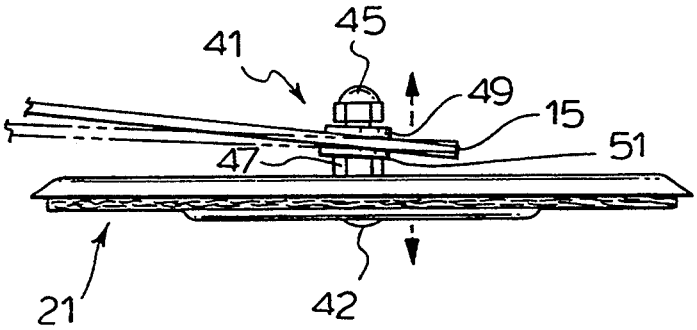

EXPLOSION DAMPENER

FIELD OF THE INVENTION

The present invention relates to a base fireplace explosion dampener which fits over a pressure relief opening in the firebox of a gas fireplace.

BACKGROUND OF THE INVENTION

Gas burning fireplaces operate based on a supply of gas introduced to the firebox in the fireplace. The gas is ignited to produce a fire. The possibility exists that ignition may not occur until there is substantial build up of gas in the firebox in which case there is a resultant explosion. Gas operated fireplaces are therefore provided with pressure relief openings covered by some type of a pressure relief valve otherwise known as an explosion dampener. An explosion dampener will normally seal the pressure relief opening from the firebox and is designed to automatically open and then close in the event of an explosion.

There are different types of explosion dampeners presently available on gas burning fireplaces. However, many of the in-use explosion dampeners are subject to failure because they warp with heat of the firebox and as a result of the warpage, will not over time provide an effective seal at the pressure relief opening. This creates a dangerous situation in that fumes created within the firebox are then allowed to leak into the surrounding room air.

In addition, most currently available explosion dampeners are quite expensive in design and add substantially to the cost of the fireplace.

SUMMARY OF THE INVENTION

The present invention provides an explosion dampener which is simple in construction and therefore relatively inexpensive from a manufacturing standpoint. However, at the same time the explosion dampener of the present invention is one which is extremely effective in performing its releasable sealing function at a pressure relief opening in the firebox of a gas fireplace.

More particularly, an explosión dampener of the present invention which is used at a pressure relief opening in a gas fireplace, comprises a fireplace mounting bracket, a lever arm pivotally secured to the mounting bracket and a sealing member which is secured by a floating or loose connection to the lever arm. The sealing member seats over and seals the pressure relief opening. The floating connection of the seal ling member to the lever arm allows the sealing member to seat regardless of warpage to either the top of the firebox or the lever arm itself.

BRIEF DESCRIPTION OF THE DRAWINGS

The above as well as well as other advantages and features of the present invention will be described in greater detail according to the preferred embodiments of the invention in which;

FIG. 5 is an exploded perspective view of the sealing member end of the explosion dampener of FIG. 2;

FIGS. 6 and 7 are end and side views respectively of the sealing member mounted to the lever arm and the floating connection between the sealing member and the lever arm.

DETAILED DESCRIPTION ACCORDING TO THE PREFERRED EMBODIMENTS OF THE PRESENT INVENTION

Figure 1:
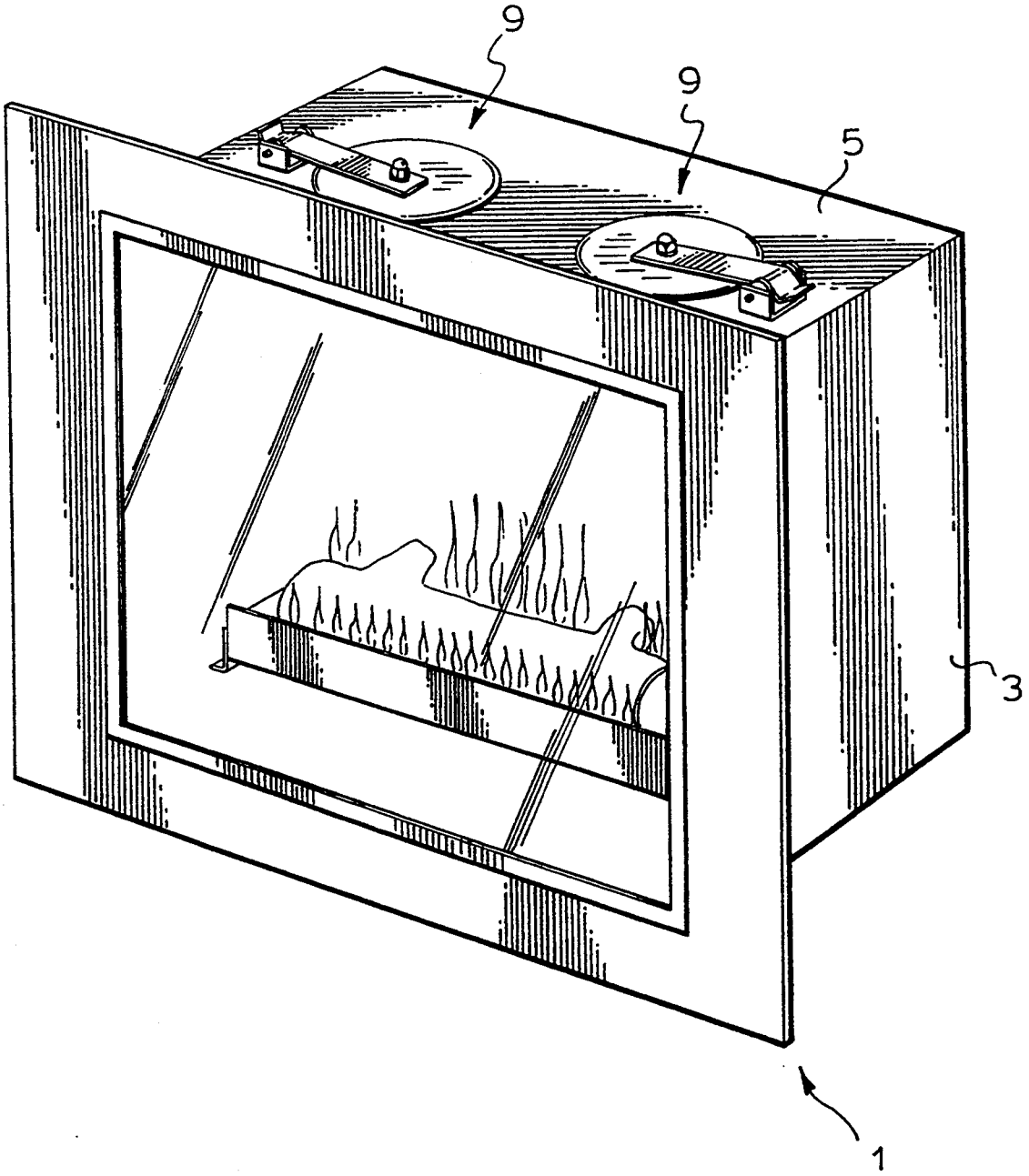
FIG. 1 is a perspective view of a firebox from a gas burning fireplace with an explosion dampening system according to a preferred embodiment of the present invention.
Figure 2:
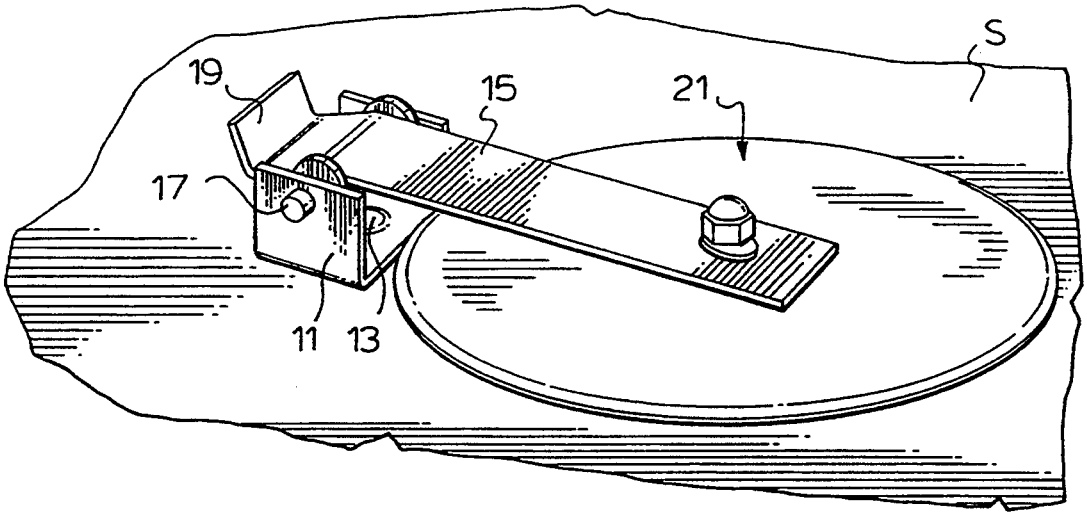
FIG. 2 is an enlarged perspective view of one of the explosion dampeners from the assembly of FIG. 1.
Figure 3:
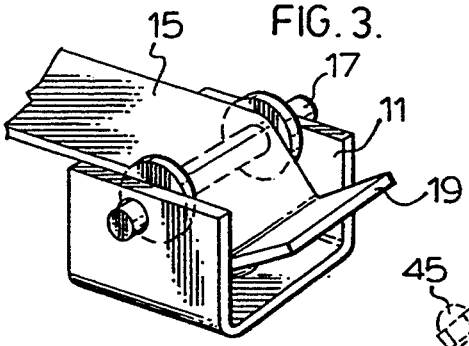
FIG. 3 is an enlarged perspective view of the mounting bracket from the explosion dampener of FIG. 2.
Figure 4:
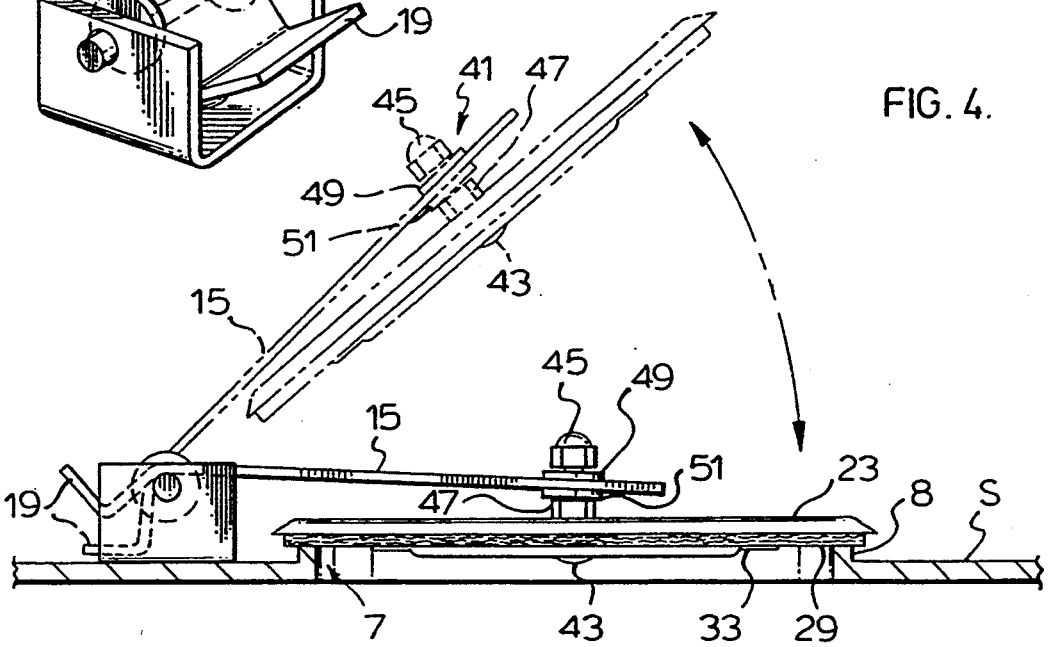
FIG. 4 is a side view showing operation of the explosion dampener of FIG. 2.

FIG. 1 shows part of a gas burning fireplace, generally indicated at 1. This gas burning fireplace includes a firebox 3 having a top wall 5. This top wall includes a pair of spaced apart pressure relief openings which are specifically provide in the event of an explosion internally of the firebox. One of these openings generally indicated at 7 is seen in FIG. 4 of the drawings. Opening 7 is defined by a peripheral lip 8.

Each of the pressure relief openings is releasably sealed by a damper explosion member generally indicated at 9. If there is an explosion, either one of both of the explosion dampener members are mounted in a manner such that they can be pushed relatively easily upwardly off of the pressure relief openings and following such an explosion, they automatically fall back to a sealing position atop the pressure relief openings. Again, it is important that they do seal the openings to prevent the escape of dangerous fumes from the firebox directly into the room in which the fireplace is located.

Each of the explosion dampeners 9 comprise a mounting bracket 11 which is secured, as indicated at 13 directly to the top wall of the firebox to one side of each of the pressure relief openings. A lever arm 15 is pivotally mounted at 17 to the mounting bracket. The rearward end of the lever arm 15 which extends beyond mounting bracket 11 is provided with a foot 19. A pressure relief opening covering member generally indicated at 21 is provide at the forward end of lever arm 15.

Foot 19 on the lever arm provides the very important function that it does not allow the lever arm when pushed up by an explosion to move to a position that it will not automatically return by gravity back down to the pressure relief opening. In other words, foot 19 as shown in the dotted line position of FIG. 4 acts as a stop to prevent the lever arm from reaching anything greater than a 90° angle from its normally generally horizontal position. In the particular arrangement shown the foot actually ensures that the lever arm doesn't go anything above about a 60° angle relative to horizontal and therefore ensures that the lever arm under the weight of sealing member 21 automatically falls back to its sealing position atop pressure relief opening 7.

The sealing member generally indicated at 21 comprises an upper plate member 23 with a downwardly turned lip 25, a gasket member 29 and a lower plate 33. Gasket 29 is made from a flame retardent sealing material such as ceramic fibre or the like which is sufficiently soft such that when it seats on the raised lip 8 around pressure relief opening 7, the lip is embedded in and sealed by the gasket member 29.

Gasket 29 is of the same or at least substantially the same diameter as upper plate 23. The lip 25 on the plate 23 sits immediately around the outside of gasket 29. Plate 33 on the other hand is of substantially smaller diameter than both the gasket and the upper plate and this therefore ensures that the gasket 29 is exposed to the bottom side of the upper plate where it seats over the pressure relief opening. The lower plate 33 includes a stiffening rib 35 which adds substantially to the overall strength of the sealing member 21.

Plate 23 includes a center opening 27, gasket 29 includes a center opening 31 and plate 33 includes a center opening 37. These openings all align with one another to receive a nut and bolt combination described with respect to FIGS. 6 and 7 of the drawings. This nut and bolt combination ensures that gasket 29 is tightly sandwiched between plates 23 and 33.

A very important feature of the present invention is a floating connection generally indicated at 41 between lever arm 15 and sealing member 21 best shown in FIGS. 6 and 7 of the drawings. This floating connection is provided in a very simple, yet efficient manner. More particularly, a bolt 43 is fitted through the aligned openings of the two plate members and the gasket of the plate assembly with a nut 47 then being tightened onto the bolt directly behind plate 23 to ensure a tight clamping of the two plate members and the gasket. The length of bolt 43 extends well beyond nut 47 upwardly through lever arm 15. A pair of washers 49 and 51 are fitted on the bolt to opposite sides of the lever arm and finally a lock nut 45 is threaded onto the end of the bolt. The lock nut although being very positively secured to the bolt is not tightened down along the length of the bolt and the diameter of the bolt is undersized relative to the diameter of the hole through the lever arm leaving a substantial amount of play between the sealing member and the lever arm. This then produces what has been referred to above as the floating connection, which as shown in FIGS. 6 and 7 of the drawings allows a self-levelling of the sealing member 21 and substantially assures sealing of gasket 29 over the peripheral lip 8 of pressure relief opening 7. Accordingly, even if arm 15 should somehow become slightly bent during an explosion or on the other hand the top wall of the firebox itself should become warped, sealing member 21 is allowed to float at the end of the lever arm and will automatically seat with the pressure relief opening.

Other than the gasket material, the explosion dampener device, including the mounting bracket, the lever arm and both of the plates 23 and 33 are made from lightweight sheet metal which is relatively inexpensive from a manufacturing standpoint and which further keeps the weight of the explosion dampening device relatively light so that the explosion dampening device will lift off of its seat when exposed to even a relatively insignificant explosion within the firebox.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An explosion dampener for a pressure relief opening in a gas fireplace, said explosion dampener comprising a fireplace mounting bracket, a lever arm pivotally secured to said mounting bracket and an opening sealing member secured by a floating connection to said lever arm, said sealing member having a multiple piece construction comprising an upper plate, an intermediate flame resistant gasket and a lower plate connected to said upper plate with said gasket trapped between said plates, said lower plate being decreased in diameter relative to said gasket and said upper plate.

2. An explosion dampener as claimed in claim 1, wherein said lower plate includes a strengthening rib.

3. An explosion dampener as claimed in claim 1, wherein both said plates and said gasket are of a circular configuration.

4. An explosion dampener as claimed in claim 1, wherein said lever arm extends from said mounting bracket in one direction to said sealing member and in the opposite direction to a blocking foot on said lever arm.

5. A gas fireplace comprising a firebox having a top wall, at least one explosion relief opening in said top wall and an explosion dampener at said opening, said explosion dampener comprising a mounting bracket, a lever arm pivotally secured to said mounting bracket and an opening sealing member secured by a floating connection to said lever arm, said mounting bracket being located to one side of said explosion relief opening and said leverage arm extending generally horizontally to place said sealing member over said opening, said lever arm being pivotal upwardly to lift said sealing member off of said opening and including an end stop which limits upward travel of said lever arm to an angle of 90° and less from horizontal.

* * * * *